US009161886B2

(12) United States Patent
Haberman et al.

(10) Patent No.: US 9,161,886 B2
(45) Date of Patent: Oct. 20, 2015

(54) FEEDING APPARATUS

(75) Inventors: Mandy Haberman, Herts (GB); Paul Bottomley, Hampshire (GB); Steve Reese, Hampshire (GB); James Turner, Dorset (GB); Colin Jones, Anglesey (GB)

(73) Assignee: Haberman Products Limited (GB)

( * ) Notice: Subject to any disclaimer, the term of this patent is extended or adjusted under 35 U.S.C. 154(b) by 710 days.

(21) Appl. No.: 12/809,169

(22) PCT Filed: Dec. 22, 2008

(86) PCT No.: PCT/GB2008/004234

§ 371 (c)(1),
(2), (4) Date: Aug. 31, 2010

(87) PCT Pub. No.: WO2009/081145

PCT Pub. Date: Jul. 2, 2009

(65) Prior Publication Data

US 2010/0314347 A1 Dec. 16, 2010

(30) Foreign Application Priority Data

Dec. 21, 2007 (GB) ..... 0725098.8

(51) Int. Cl.
*A61J 9/04* (2006.01)
*A61J 11/00* (2006.01)

(52) U.S. Cl.
CPC . *A61J 9/04* (2013.01); *A61J 11/002* (2013.01)

(58) Field of Classification Search
CPC ..... A61J 9/04; A61J 11/002
USPC ..... 215/6, 11.1, 11.4, 11.5; 220/714, 254.1, 220/715
See application file for complete search history.

(56) References Cited

U.S. PATENT DOCUMENTS 4,138 A 8/1845 Pratt
2,544,464 A * 3/1951 Matthews et al. ..... 215/11.5
(Continued)

FOREIGN PATENT DOCUMENTS

DE 399393 C 8/1924
DE 497999 C 5/1930
(Continued)

OTHER PUBLICATIONS

First Chinese Office Action dated Jan. 15, 2013 with translation supplied by JA Kemp.
(Continued)

*Primary Examiner* — Tri Mai
(74) *Attorney, Agent, or Firm* — Harness, Dickey & Pierce, P.L.C.

(57) ABSTRACT

Colic can be a particular problem for babies feeding on liquid feed from a feeder bottle. The colic can be formed by air from various sources in the liquid feed. Typically, there is less air in the liquid feed towards the bottom of the liquid feed container in the feeding position than towards the top of the liquid feed. The present invention provides apparatus for drawing milk from the bottom of the feeding apparatus chamber when the feeder is held in the operating position. This is achieved by positioning a flow restrictor for allowing the passage of liquid feed from a main chamber into a flexible feeding teat at a suitable location. The present invention also provides a resiliently-biased cartridge to assist in priming and/or draining of the flexible feeding teat. The present invention also provides a construction in which the flow restrictor is always provided in the correct position regardless of the relative angular orientation of the elements of the feeder. The present invention also provides feeding apparatus that can be easily disassembled to facilitate cleaning.

21 Claims, 13 Drawing Sheets

(56) References Cited

U.S. PATENT DOCUMENTS

| | | | | | |
|---|---|---|---|---|---|
| 2,623,524 | A | * | 12/1952 | Clemens | 215/11.4 |
| 2,745,568 | A | * | 5/1956 | Newton | 215/11.4 |
| 2,746,631 | A | * | 5/1956 | Witz | 215/11.1 |
| 2,890,113 | A | * | 6/1959 | Egli | 420/69 |
| 2,959,314 | A | * | 11/1960 | Sanchez | 215/11.1 |
| 3,139,064 | A | * | 6/1964 | Harle | 116/309 |
| 3,532,242 | A | * | 10/1970 | Tibbs | 215/11.1 |
| 3,650,271 | A | * | 3/1972 | Pelli | 215/11.1 |
| 3,704,803 | A | | 12/1972 | Ponder | |
| 3,718,140 | A | * | 2/1973 | Yamauchi | 215/11.1 |
| 3,946,888 | A | * | 3/1976 | Tonkin | 215/11.5 |
| 4,135,513 | A | | 1/1979 | Arisland | |
| 4,420,101 | A | * | 12/1983 | O'Neill | 222/212 |
| 4,613,050 | A | | 9/1986 | Atkin et al. | |
| 4,685,577 | A | * | 8/1987 | Chen | 215/11.5 |
| 4,898,291 | A | | 2/1990 | Sailors | |
| 5,150,800 | A | * | 9/1992 | Sarter et al. | 215/11.4 |
| 5,269,425 | A | | 12/1993 | Gomez-Acevedo | |
| 5,747,083 | A | | 5/1998 | Raymond et al. | |
| 5,791,503 | A | * | 8/1998 | Lyons | 215/11.5 |
| 6,112,919 | A | * | 9/2000 | Ho | 215/11.4 |
| 6,202,877 | B1 | * | 3/2001 | La Torre et al. | 220/254.1 |
| 6,253,936 | B1 | * | 7/2001 | Kong | 215/11.3 |
| 6,508,379 | B1 | * | 1/2003 | Van De Pol-Klein Nagelvoort et al. | 215/11.5 |
| 6,732,882 | B2 | * | 5/2004 | Belcastro | 220/714 |
| 6,994,225 | B2 | * | 2/2006 | Hakim | 215/11.4 |
| 7,204,380 | B2 | * | 4/2007 | Webb et al. | 215/11.4 |
| 7,210,591 | B2 | * | 5/2007 | Goldman et al. | 215/11.1 |
| 2003/0209555 | A1 | * | 11/2003 | Belcastro | 220/714 |
| 2005/0045647 | A1 | * | 3/2005 | Hession et al. | 220/714 |
| 2007/0102388 | A1 | * | 5/2007 | Lewis et al. | 215/11.1 |
| 2008/0202631 | A1 | * | 8/2008 | Loewenthal et al. | 141/26 |

FOREIGN PATENT DOCUMENTS

| | | | |
|---|---|---|---|
| DE | 507836 | C | 9/1930 |
| EP | 0151862 | A2 | 8/1985 |
| EP | 0785712 | A1 | 7/1997 |
| EP | 1354579 | A1 | 10/2003 |
| EP | 1416900 | A1 | 5/2004 |
| GB | 2154451 | A | 9/1985 |
| GB | 2169210 | A | 7/1986 |
| GB | 2421944 | A | 7/2006 |
| JP | 60-165956 | A | 8/1985 |
| NZ | 208732 | A | 2/1988 |
| WO | 95/24177 | A | 9/1995 |
| WO | 96/11569 | A1 | 4/1996 |
| WO | WO-9938423 | A1 | 8/1999 |
| WO | 02/18223 | A1 | 3/2002 |
| WO | WO-02/22073 | A1 | 3/2002 |

OTHER PUBLICATIONS

Chinese Search Report dated Jan. 7, 2013.

International Preliminary Report on Patentability, IB, Geneva, issued Jun. 22, 2010, incorporating the Written Opinion of the International Search Authority, mailed Jun. 24, 2009.

Extended European Search Report dated Oct. 9, 2014 regarding Application No. 14168726.9-1651/2799058.

* cited by examiner

FEEDING APPARATUS

CROSS-REFERENCE TO RELATED APPLICATIONS

This application is a 371 U.S. National Stage of International Application No. PCT/GB2008/004234, filed Dec. 22, 2008. This application claims the benefit of United Kingdom Patent Application No. 0725098.8, filed Dec. 21, 2007. The disclosures of the above applications are incorporated herein by reference.

This invention relates to feeding apparatuses. The apparatus finds particular application in the following uses, but is not intended to be limited to such uses. The main intended use is in the feeding of babies. The feeding apparatus is intended to be used by all babies, including both healthy babies and those who may be experiencing feeding problems. Equally, the apparatus may find application in feeding the elderly. For simplicity, in the following discussion and description the apparatus will be discussed in the context of feeding babies.

With a conventional baby feeding bottle (such as is illustrated in FIG. 3) much of the baby's effort is wasted on compression of air within the bottle and movement of feed within the bottle. Many babies swallow air while using conventional baby feeding bottles. This is because a vacuum builds up inside the system and the baby must release his or her lips from the teat of the bottle to allow air back in. As a result, air is swallowed with the next mouthful of feed, causing gas, vomiting and colic.

A company by the name of AVENT has produced a bottle which has air vents in the flange of the teats so that the baby has to suck at a lower pressure to feed. This lower pressure means that, when the baby releases the seal of its lips on the teat, less air is gulped into the mouth and potentially swallowed, thereby reducing colic. In the AVENT feeding apparatus the liquid feed, e.g. milk, is primarily delivered because of a sucking action. Consequently, the likelihood of gulping external air is still present.

In the so-called Haberman Feeder, invented by one of the co-inventors of the present application, a feeding apparatus is provided in which liquid feed is delivered because of the suckling action of the baby (as in breast feeding) and not through a sucking action. A small version of a Haberman Feeder (known as a Mini-Haberman Feeder) is illustrated in perspective view in FIG. 1. FIG. 2 shows the mouthpiece end of the apparatus in longitudinal cross-section. The apparatus comprises a container 1 for liquid feed. When assembled, as shown in FIGS. 1 and 2, a flexible mouthpiece 2 is assembled against the open end of the container 1 by threading a collar 3 onto an external thread provided at the open end of the container 1. Clamped by the collar 3 between a flange at the base of the mouthpiece 2 and the top edge of the open end of the container 1 is a valve disc 4 provided around its centre with four equispaced valve openings 5, two of which are visible in FIG. 2. Provided on the top side (as drawn in FIG. 2) of the valve disc 4 is a valve membrane 6, the periphery of which (in its default condition, as shown) closes the valve openings 5. The valve membrane 6 is attached to the valve disc 4 by the engagement of a centrally positioned stub 7, with an enlarged end, through a hole provided in the centre of the valve disc 4. The flexible mouthpiece 2 is provided at its distal feeding end with a self-closing valve in the form of a slit valve 9. A small radially directed air groove 8 is formed on the underside of the valve disc 4 so as to admit air into the container 1 (not into the interior of the flexible mouthpiece 2) during feeding.

Whilst the container 1, valve disc 4 and collar 3 are manufactured from comparatively rigid plastics material such as polypropylene, the flexible mouthpiece 2 and valve membrane 6 are manufactured from a comparatively flexible material such as silicone.

To use the Mini-Haberman Feeder, the collar 3 is unscrewed from the container 1 and the subassembly of the collar 3, mouthpiece 2 and valve disc 4 is removed from the top end of the container 1. The interior of the container 1 can then be charged with an appropriate volume of liquid feed, such as baby milk formula or expressed breast milk. Following the reassembly of the device to the assembled condition shown in FIGS. 1 and 2, by holding the apparatus upright and squeezing the flexible mouthpiece 2 between the thumb and forefinger and then inverting the apparatus whilst maintaining the squeezing action, subsequent release of squeezing pressure on the flexible mouthpiece 2 will cause some liquid feed to flow through the valve openings 5, by deflecting the valve membrane 6, from the interior of the inverted container 1 into the interior of the flexible mouthpiece 2, downstream of the valve disc 4. By repeating this sequence of actions several times until the interior of the flexible mouthpiece 2 is almost full, the flexible mouthpiece 2 can be charged with liquid feed. To feed a baby the feeding end of the flexible mouthpiece 2 is inserted into the baby's mouth, and the base of the container 1 is held slightly above the level of the baby's mouth, so that the apparatus is inclined at a gentle angle, for example of 20° to the horizontal. In this way, liquid feed in the container 1 is maintained in contact with the upstream face of the valve disc 4. If the baby needs help feeding, when the feeding end of the flexible mouthpiece 2 is located in the baby's mouth the adult feeding the baby can gently squeeze and release the cylindrical walls of the flexible mouthpiece 2 so as to squeeze a small amount of fluid from the slit valve at the distal tip of the mouthpiece 2 into the baby's mouth. Liquid feed exiting the slit valve at the end of the mouthpiece 2 is replenished by liquid feed flowing from the interior of the container 1 through the valve openings 5 by deflecting the valve membrane 6, which acts as a one-way valve.

Once the level of liquid feed in the container 1 drops below the level of the uppermost opening 5*a* of the valve openings 5 provided in the valve disc 4, air present within the container 1 can pass through the valve openings 5 in the valve disc 4 into the reservoir inside the flexible mouthpiece 2—see FIG. 4. Particularly towards the end of a feed, when the level of liquid feed within the mouthpiece 2 also drops, air within the mouthpiece 2 can be ingested by the baby.

In all of the above mentioned prior art feeding apparatuses, aeration of the liquid feed can be caused during preparation of the apparatus. Milk is served to a baby at body temperature so it is typically heated in the feeding apparatus. Regardless of how this heating is done, the feeding apparatus is shaken to ensure that the milk is thoroughly mixed before serving. If the milk is being prepared from powdered formula (rather than being expressed breast milk), then the apparatus is required to be vigorously shaken in order to mix the powder into the solution. The result of this shaking is to aerate the milk heavily.

Without wishing to be bound by the following theory, it is thought that air is retained in baby milk in two forms: as foam and as tiny bubbles in the milk itself.

Foam is present on the top surface of the milk and gradually clears during the feed. The rate at which this happens is dependent upon the amount of fat in the milk; the less fat the longer the foam lasts. Typically foam of this sort dissipates before the end of a feed. In a conventional baby feeding bottle 20 of the sort illustrated in FIG. 3, comprising a container 21 and a mouthpiece 22 provided with a slit 23, the baby can easily swallow this foam (shown in FIG. 3 as a series of bubbles), particularly if the child moves or if the parent does not keep the bottle upright.

Even in a Mini-Haberman Feeder, this surface foam can pass through the valve openings 5 in the valve disc 4 into the reservoir inside the flexible mouthpiece 2 if the top surface of the milk present in the container 1 is coincidental with a valve opening 5 (see FIG. 4), which can occur early on during the feeding process due to the high location of the uppermost valve opening referenced 5*a* in FIG. 4.

The tiny bubbles present in shaken milk are held within the milk, primarily because of the viscosity. If the bubbles are sufficiently small they are insufficiently buoyant as to rise to the surface of the milk and escape. Over time and during the feed, these tiny bubbles will collide with one another, coalesce, and become sufficiently large as to rise ultimately to the surface of the milk.

In the above described prior art feeding apparatuses, the valve openings through which the milk passes are generally centrally located (see FIGS. 2 to 4) when the apparatus is in an orientation appropriate for feeding, meaning that the foam and the tiny bubbles within the milk will be in the vicinity of the valve opening for quite some time (and early in the feed, when aeration is greatest) risk being ingested by the baby.

A final way in which a baby can end up swallowing air during feeding is simply by the feeding apparatus being held too close to the horizontal (for example see FIG. 3) so that air is sucked through by the baby and not milk, even when the apparatus still contains a large amount of milk. Although this is less likely to happen with a Haberman Feeder than with the prior art baby feeding bottle illustrated in FIG. 3, it is still likely that some air, particularly towards the end of a feed, will be sucked through.

There is a need for a feeding apparatus in which the chances of air being ingested from the apparatus, rather than liquid feed, is reduced. It is thought that this will provide advantages in terms of the reduction of colic.

According to the present invention there is provided a feeding apparatus comprising a container having an open end and for defining a main chamber therein. The feeding apparatus may further comprise a flexible mouthpiece for assembly to the end of the container. The flexible mouthpiece may define a secondary chamber therein. The mouthpiece may also include a protruding teat provided at a feeding end. The protruding teat may have a self-closing valve. The feeding apparatus may further comprise a partition for separating the main and secondary chambers and having a geometric centre. The feeding apparatus may further comprise at least one one-way valve provided in the partition to allow the forward flow of liquid feed from the main chamber to the secondary chamber and to prevent the flow of liquid feed in the reverse direction. The one-way valve or valves may be offset from the geometric centre of the partition. The feeding apparatus may further comprise an indicator, other than the valve or valves, for indicating to a user of the apparatus the location of the one-way valve or valves relative to the geometric centre of the partition. This may enable the one-way valve or valves to be entirely positioned below the geometric centre of the partition when the assembled apparatus is held by the user with the teat extending generally horizontally.

According to the invention there is also provided a feeding apparatus comprising a container having an open end and for defining a main chamber therein. The feeding apparatus may comprise a flexible mouthpiece for assembly to the open end of the container and for defining a secondary chamber therein. The mouthpiece may include a protruding teat provided at a feeding end. The feeding apparatus may also comprise a partition for separating the main and secondary chambers and having a geometric centre. The feeding apparatus may also comprise at least one flow restrictor arranged to allow liquid feed to flow from the main chamber to the secondary chamber. The feeding apparatus may be arranged such that, regardless of the relative angular orientation of the assembled partition and container, the partition and the flexible mouthpiece are constructed and arranged to form the or each flow restrictor in a position that can be entirely below the geometric centre of the partition when the assembled apparatus is held, in use, by the user with the teat extending generally horizontally.

According to the invention there is also provided a feeding apparatus comprising a container having an open end and for defining a main chamber therein. The feeding apparatus may also comprise a flexible mouthpiece for assembly to the open end of the container and for defining a secondary chamber therein. The mouthpiece may include a protruding teat provided at a feeding end. The feeding apparatus may also comprise a partition for separating the main and secondary chambers upon assembly of the container to the mouthpiece and having a geometric centre. The container, mouthpiece and partition may be constructed and arranged so that, when the apparatus is assembled for use, at least one flow restrictor, to allow liquid feed to flow from the main chamber to the secondary chamber, is automatically formed between a portion of the mouthpiece and a portion of the partition.

According to the invention there is also provided a feeding apparatus comprising a container having an open end and for defining a main chamber therein. The feeding apparatus may also comprise a flexible mouthpiece for assembly to the open end of the container and for defining a secondary chamber therein. The mouthpiece may include a protruding teat provided at a feeding end. The feeding apparatus may also comprise a partition for separating the main and secondary chambers and having a geometric centre. The feeding apparatus may comprise at least one flow restrictor. The flow restrictor may be constructed and arranged to allow liquid feed to flow from the main chamber to the secondary chamber. The partition may be formed by a resiliently biased cartridge. At least part of the resiliently biased cartridge may be configured to be biased towards a first position, and moveable against the bias from the first position to a second position. The biased cartridge may be configured at least substantially to close a path for the flow of liquid feed between the main chamber and the secondary chamber when the moveable part is in the first position. The biased cartridge may be configured at least substantially to open said path when said moveable part is in the second position.

According to the present invention, there is also provided a method of feeding a baby using the feeding apparatus disclosed herein, the method comprising: holding the assembled apparatus; and using an indicator to position the at least one one-way valve to take liquid feed from a region of the main chamber below the geometric centre of the partition when the assembled apparatus is held with the teat extending generally horizontally.

An embodiment of apparatus will now be described, by way of example only, with reference to the accompanying drawings, in which.

Figure 14:
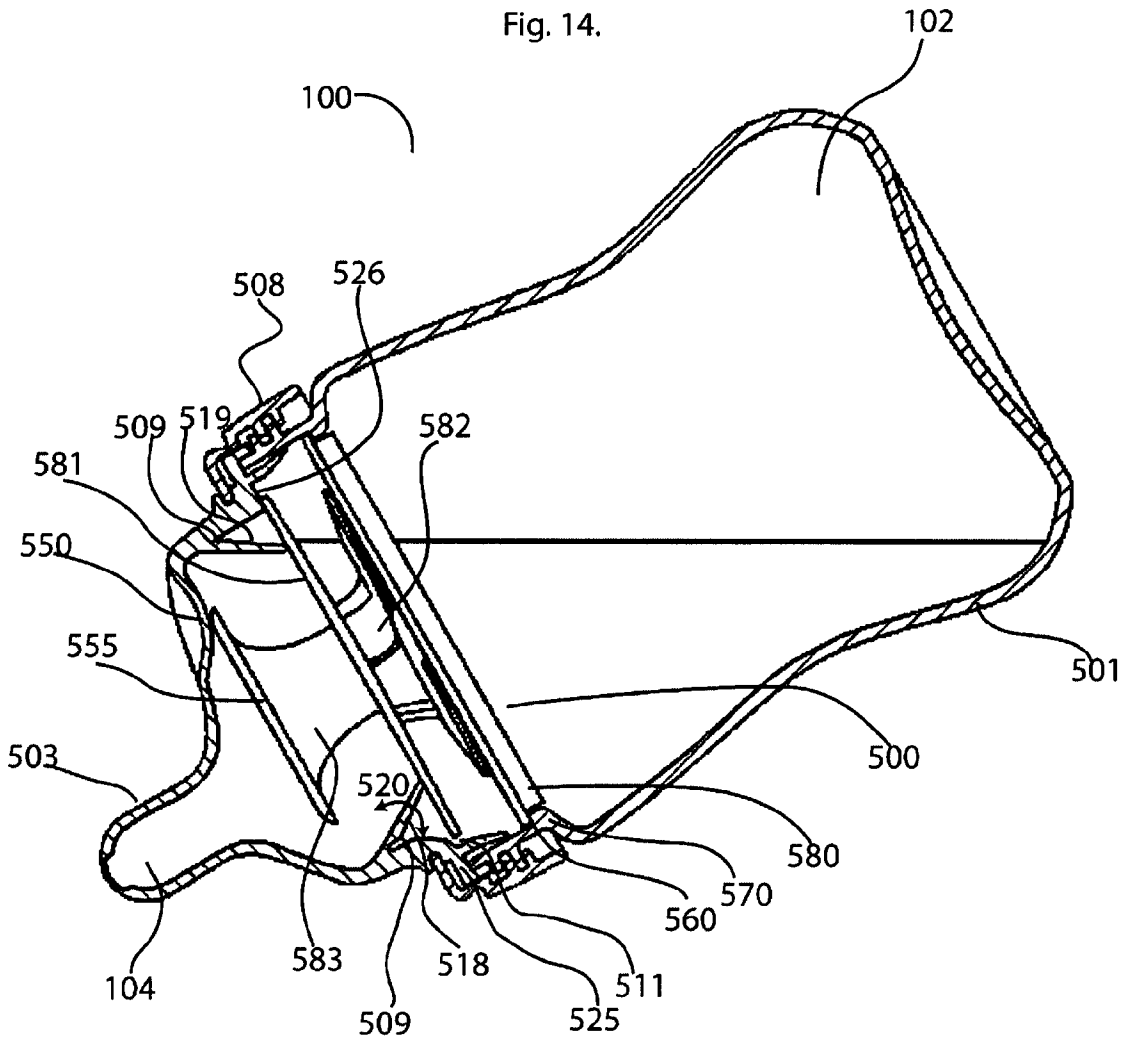
Figure 15:
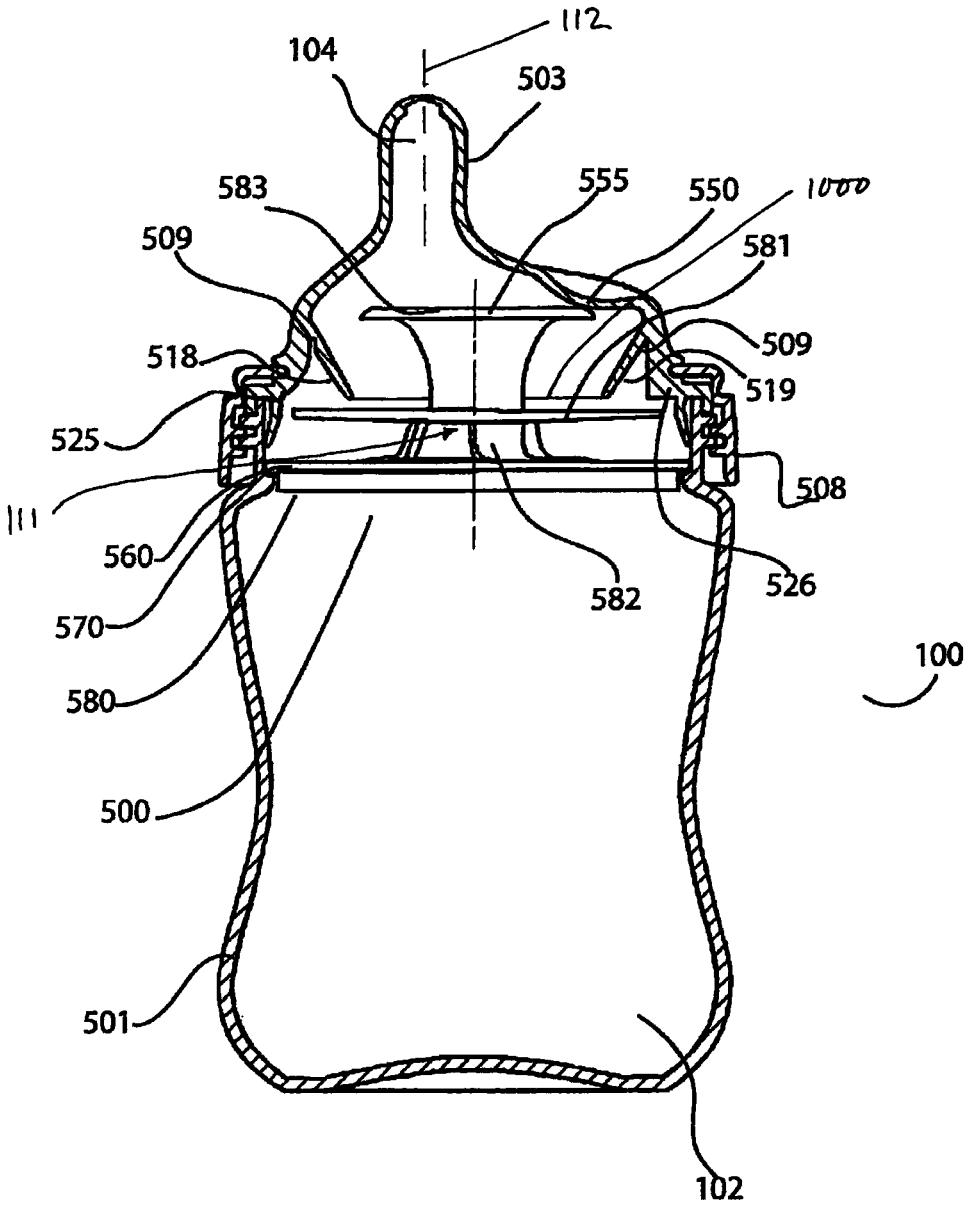

FIG. 14 is a longitudinal cross-section of an embodiment of feeding apparatus in accordance with the present invention comprising a resiliently-biased cartridge and a closed flap-valve, with the teat shown downwardly inclined as in use; and FIG. 15 is a longitudinal cross-section of the embodiment of feeding apparatus shown in FIG. 14, but with the resiliently-biased cartridge shown in the open position.

Figure 16:
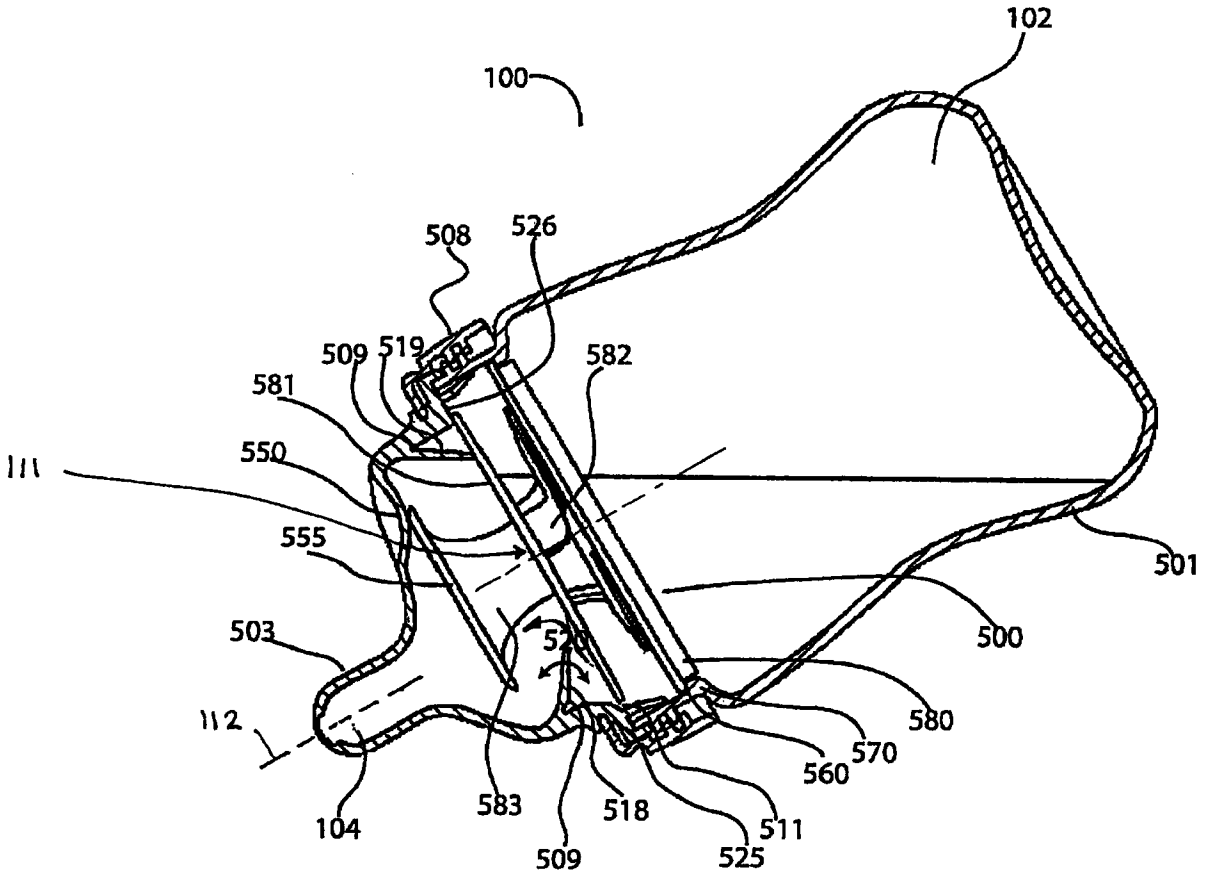

FIG. 16 is a longitudinal cross-section of the embodiment of feeding apparatus shown in FIG. 14, but with the flap valve in an open position.

Figure 17:
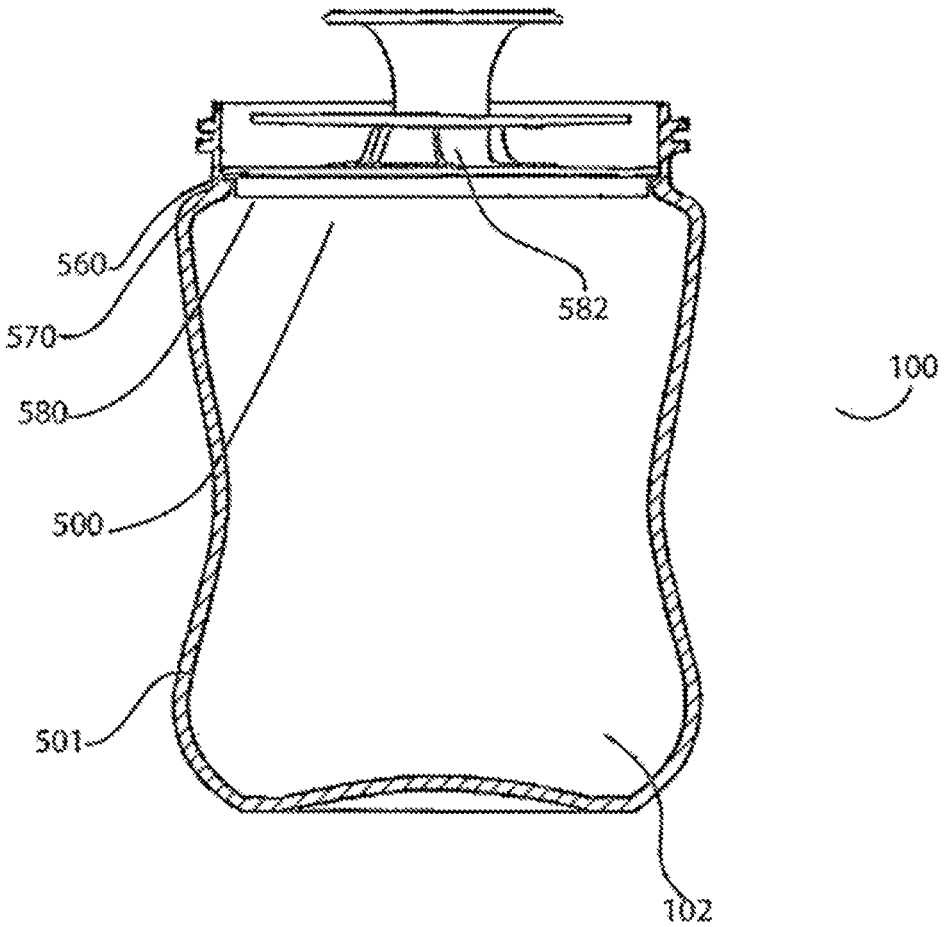

FIG. 17 is a longitudinal cross-section of the embodiment of feeding apparatus shown in FIG. 14, but with a mouthpiece removed from the feeding apparatus.

Figure 18:
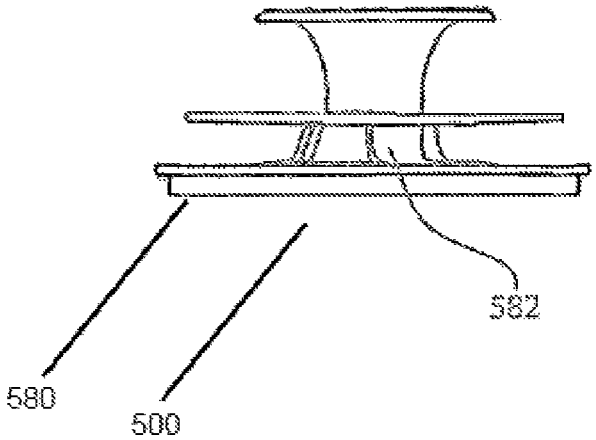

FIG. 18 is a side elevation view of the embodiment of feeding apparatus shown in FIG. 14, but with a main chamber and a mouthpiece removed from the feeding apparatus.

Figure 5:
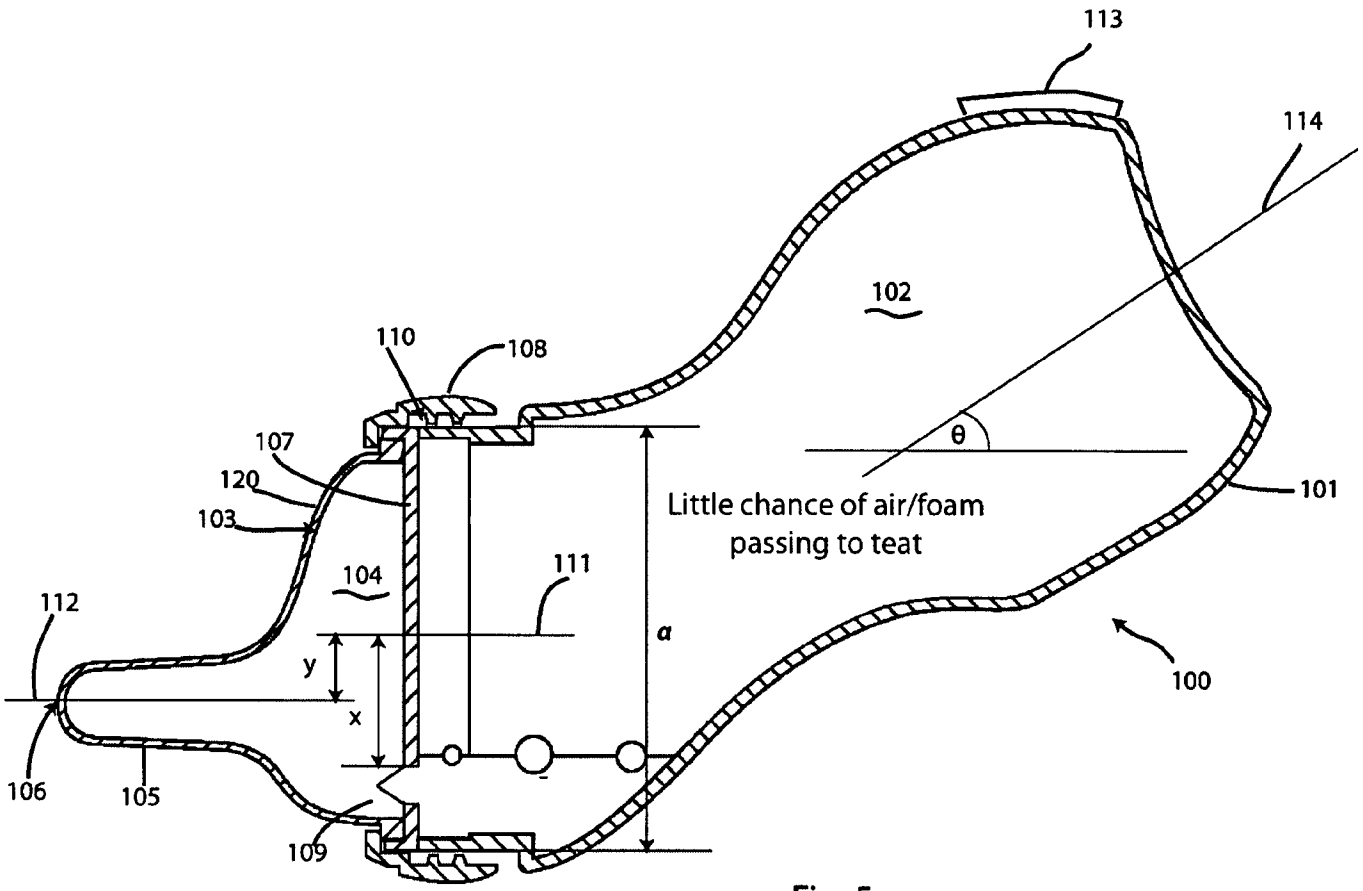
FIG. 5 is a longitudinal cross-section of an embodiment of feeding apparatus in accordance with the present invention, in a use orientation, showing, despite the low level of liquid feed in the container's main chamber, the reduced risk of air/foam passing into the flexible mouthpiece for ingestion by a feeding baby.
Figure 6:
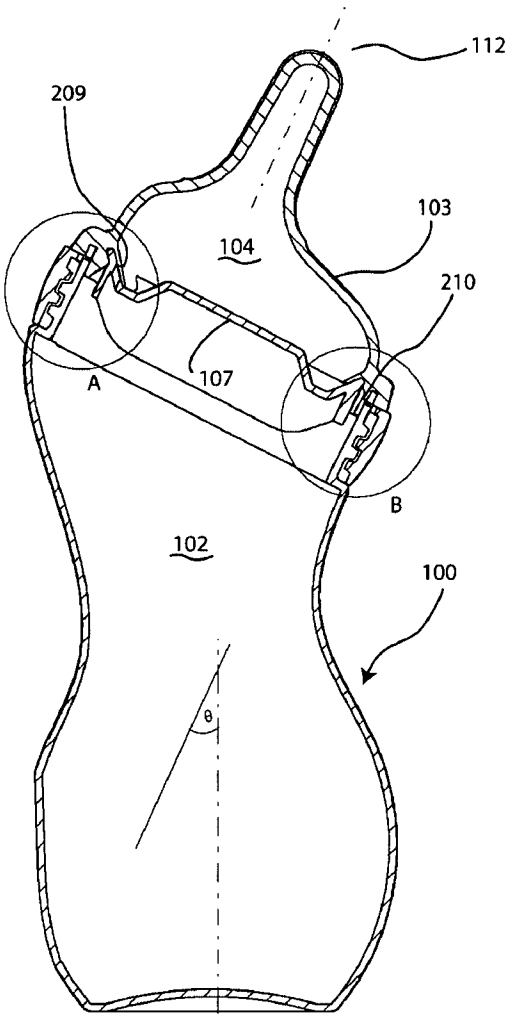
FIG. 6 is a longitudinal cross-section of another embodiment of feeding apparatus in accordance with the present invention.
Figure 9:
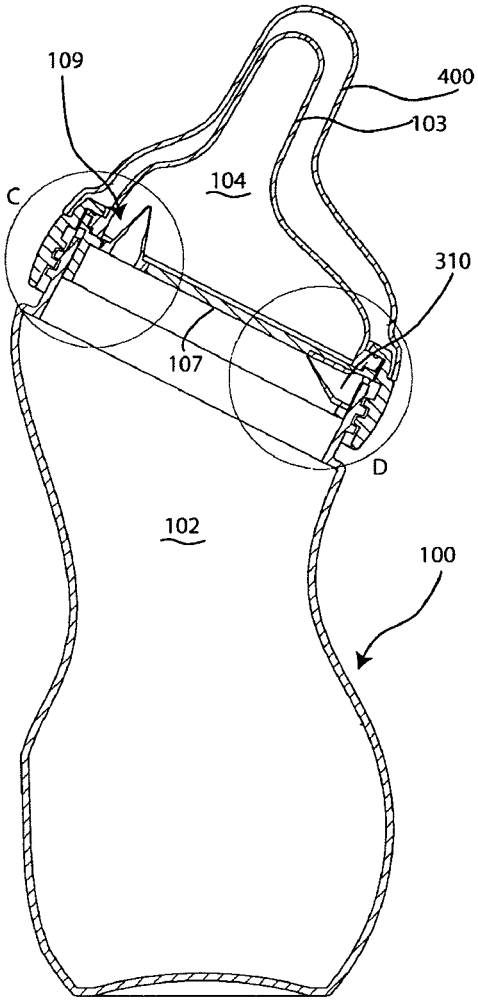
FIG. 9 is a longitudinal cross-section of an alternative embodiment of feeding apparatus in accordance with the present invention.

The feeding apparatus 100 illustrated in FIG. 5 is shown in its assembled condition, towards the end of a feed. Alternative embodiments of feeding apparatus 100 are shown in FIGS. 6, 9 and 14. These alternative embodiments, especially those of FIG. 6 and FIG. 9, share many features with the embodiment shown in FIG. 5. As shown in FIG. 5, the apparatus 100 comprises a container 101 having an open end (to the left as drawn). The container 101 defines a main chamber 102 therein for receiving liquid feed, such as powdered milk formula, expressed breast milk or the like. A suitable material for manufacture of the container 101 would be polypropylene.

Assembled against the open (left hand) end of the container 101 is a flexible mouthpiece 103. A suitable material for the manufacture of the mouthpiece would be silicone. The flexible mouthpiece 103 defines a secondary chamber 104 therein. The mouthpiece 103 includes a protruding teat 105 provided at its distal tip, or feeding end, with a self-closing valve 106 in the form of a slit.

A partition 107 is clamped between a flange at the base of the flexible mouthpiece 103 and the annular rim at the open end of the container 101 using an annular clamp or collar 108. The clamp or collar 108 enables the apparatus to be readily disassembled after use for cleaning and could also readily be moulded in polypropylene.

Figure 10:
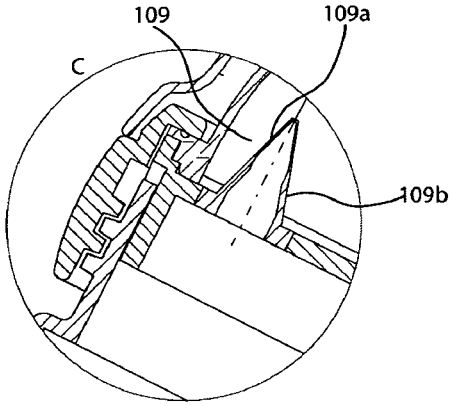
FIG. 10 is an enlarged view of region C of FIG. 9 showing a cross-sectional view of a valve for allowing the forward flow of liquid feed from a main chamber to a secondary chamber of the feeding apparatus.

In the assembled apparatus the partition 107 separates the main chamber 102 from the secondary chamber 104. The partition 107, which could suitably be made from polypropylene, is provided with a flow restrictor in the form of a single one-way valve 109. In the embodiment of FIG. 5 (and FIG. 9) this one-way valve 109 takes the form a leaf valve, but other known constructions of one-way valve would also be suitable. An enlarged view of valve 109 is shown in FIG. 10. The two leaves 109*a*, 109*b* of the leaf valve extend from the partition 107, around a valve opening in the partition, and converge into contact. The leaves may be made of the same material as and formed with the main planar portion of the partition 107. Alternatively they may form part of a discrete valve 109 that is made from a different (e.g. more flexible material) such as silicone, which is then embedded in the relatively rigid partition 107, for example by two-stage moulding. The purpose of the one-way valve 109 is to allow the forward flow of liquid feed from the main chamber 102 into the secondary chamber 104 through the valve's opening in the partition 107, but to prevent the flow of liquid feed in the reverse direction.

Figure 7:
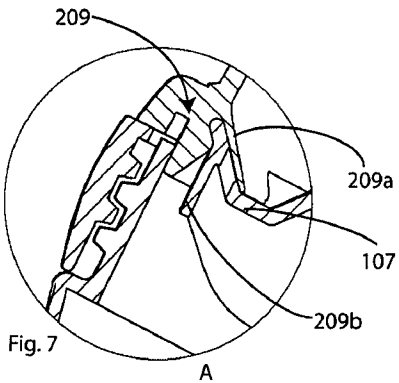
FIG. 7 is an enlarged view of region A of FIG. 6 showing a cross-sectional view of a valve for allowing the forward flow of liquid feed from a main chamber to a secondary chamber of the feeding apparatus.

Alternative one-way valves could be provided between the main chamber 102 and the secondary chamber 104. An example of an alternative one-way valve 209 is shown in the embodiment of FIG. 6. An enlarged view of this alternative one-way valve 209 is shown in FIG. 7. The one-way valve 209 of this embodiment may comprise a flap 209*a* which may engage with the partition 107 in a closed position. The flap 209*a* may also be supported by support 209*b* so as to be located in the correct position when the valve is closed. When sufficient force in a direction from the main chamber 102 to the secondary chamber 104 is provided to the flap 209*a* (for example, due to the pressure in the liquid in the main chamber 102 being greater than that in the secondary chamber 104), it may extend into the secondary chamber 104. This would, in turn, allow liquid feed to flow from the main chamber 102 to the secondary chamber 104.

The or each one-way valve 109/209 acts as a flow restrictor. The or each flow restrictor is designed to permit and/or facilitate the forward flow of liquid feed from the main chamber 102 to the second chamber 104, and to resist or restrict the flow of liquid feed in the reverse direction (i.e. from the secondary chamber 104 to the main chamber 102). In a modification (not shown) of the FIG. 5 and FIG. 6 embodiments, the one-way valve or valves 109/209 may be replaced by simple apertures (such as holes or openings) without a moveable valve element. These simple apertures may be provided in the partition 107. Alternatively, the apertures may be provided in the mouthpiece 103.

The aperture or apertures may, for example, be tapered in cross-section to provide a greater resistance to reverse flow therethrough than to forward flow therethrough. The or each aperture might be tapered such that its cross-sectional area at its opening to the main chamber 102 is greater than its cross-sectional area at its opening to the secondary chamber 104. Any cross-sectional shape of aperture may be used. For example, the aperture or apertures may be circular in cross-section. Thus, each aperture or apertures may have a circular cross-section, with a larger diameter at the opening to the main chamber 102 than the diameter at the opening to the secondary chamber 104, to render the apertures frusto-conical in shape. Much of the subsequent description concerning FIGS. 5 to 13 relates to embodiments in which one-way valves 109/209 are used. However, it will be understood that these one-way valves could be replaced with simple apertures such as those described above. Indeed, the flow restrictors could be either one-way valves or apertures in any of the embodiments described herein.

In order for liquid feed to be able to flow from the main chamber 102 through the one-way valve 109, an air vent 110 is provided. This air vent 110 may take the form of a small radial notch on the underside (right hand side as drawn in FIG. 5) of the partition 107 at a position diametrically opposite to the one-way valve 109 relative to the geometric centre 111 of the partition 107. This small radially directed groove allows air to vent into the main chamber 102 from outside of the apparatus 100 as the level of liquid feed within the main chamber 102 drops during a feeding operation, but is not so large that any appreciable leakage of liquid feed will take place through the vent 110 if the apparatus is shaken or inadvertently dropped. Alternatively, the vent 110 could be replaced with a valve to allow air entry into the main chamber and to prevent the escape of liquid contents from the main chamber back through the valve.

Figure 8:
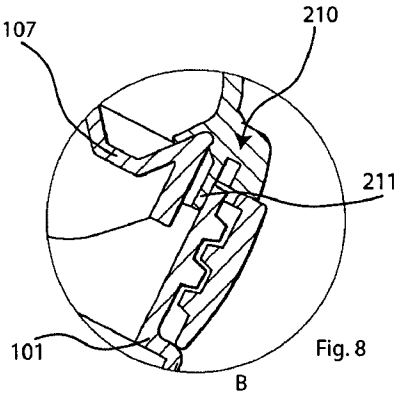
FIG. 8 is an enlarged view of region B of FIG. 6 showing a cross-sectional view of an air vent for allowing air to enter a main chamber of the feeding apparatus from outside the feeding apparatus.
Figure 11:
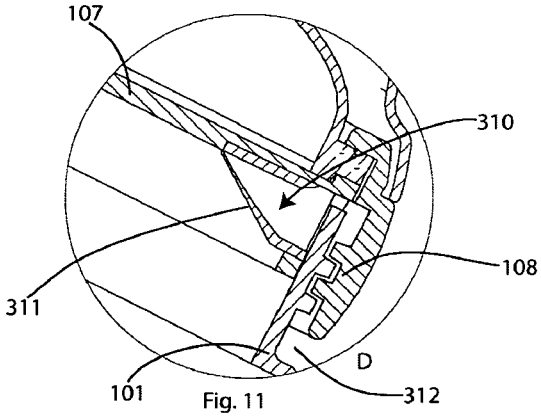
FIG. 11 is an enlarged view of region D of FIG. 9 showing a cross-sectional view of an air vent for allowing air to enter a main chamber of the feeding apparatus from outside the feeding apparatus.

Possible vents or valves for allowing air to enter the main chamber 102 from outside the feeding apparatus 100 are shown in FIGS. 8 and 11. These vents or valves may be provided in the same position in feeder 100 as the air vent 110 shown in FIG. 5 and described above. The valve 210 shown in FIG. 8 has a flap 211 which may rest against an inner wall of the main container 101 in a closed position so that air cannot flow into (or out of) the main chamber 102 via this valve. The flap 211 can be configured such that when the pressure on the outside of the main chamber 102 is sufficiently greater than the pressure on the inside, the flap 211 can move away from the container wall 101. This allows air to enter main chamber 102 from outside the feeder 100. In the valve 310 arrangement shown in FIG. 11, a flap 311 is provided. This flap may rest against the partition 107 in a closed position to prevent air from entering (or leaving) the main chamber 102. The flap 311 is configured to open when the air pressure outside the feeder 100 is sufficiently greater than the air pressure inside the main chamber 102. This causes the flap 311 to move away from the partition 107, thereby forming a gap between the partition 107 and the flap 311. This allows air to enter the main chamber 102 from outside the feeder 100 via a gap 312 between the collar 108 and the container 101.

Figure 12:
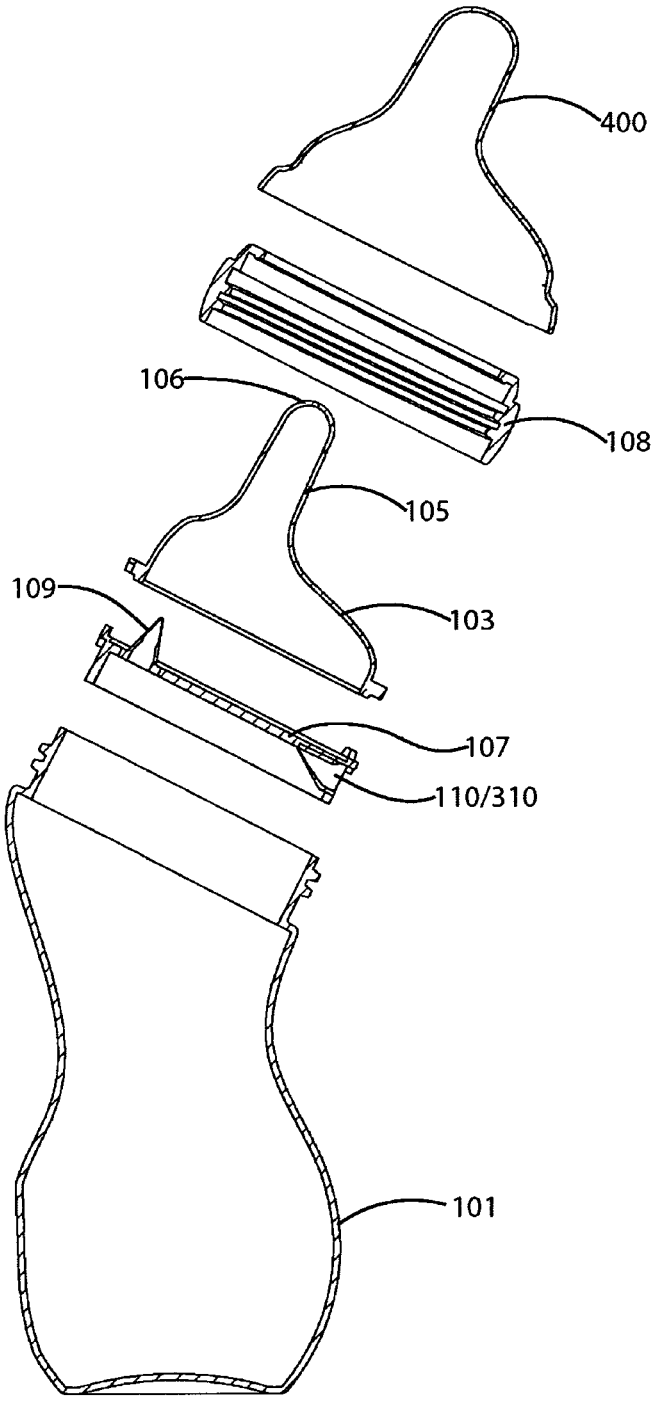
FIG. 12 is a longitudinal cross-section of an exploded view of a feeding apparatus according to the present invention showing elements of a feeding apparatus prior to assembly.
Figure 13:
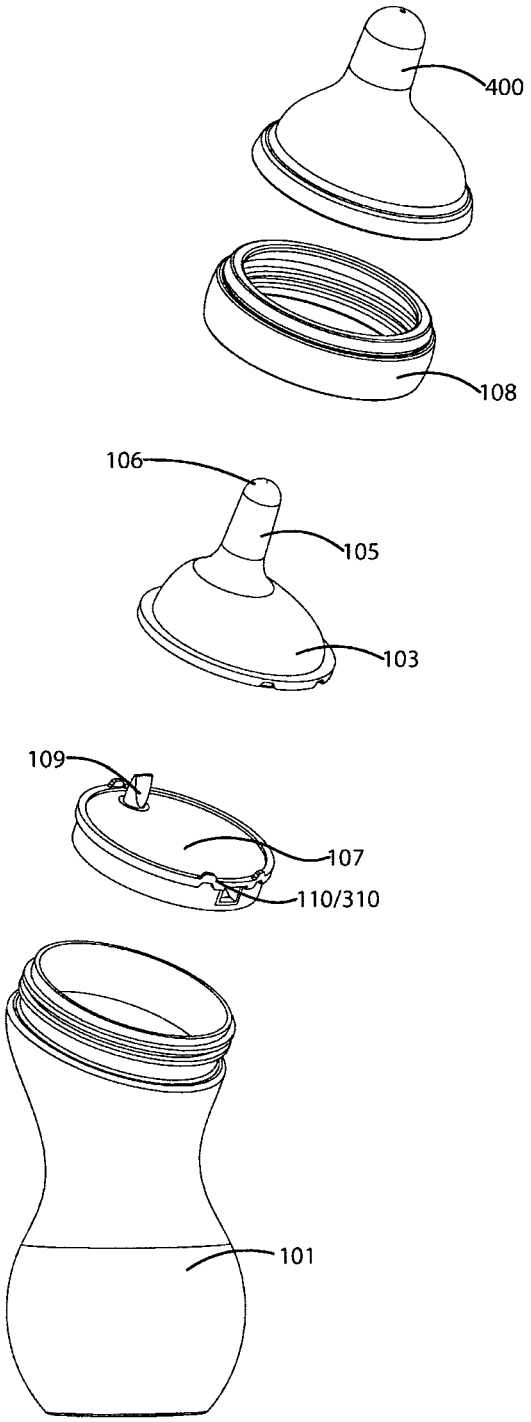
FIG. 13 is a perspective exploded view showing elements of a feeding apparatus according to the present invention prior to assembly.

The various elements of an embodiment of feeding apparatus according to the present invention are shown in exploded view in FIGS. 12 and 13. In addition to the elements described above, FIGS. 12 and 13 also have a removable, non-essential, cover 400. This cover 400 is to assist in keeping the flexible mouthpiece 103 clean.

Figure 1:
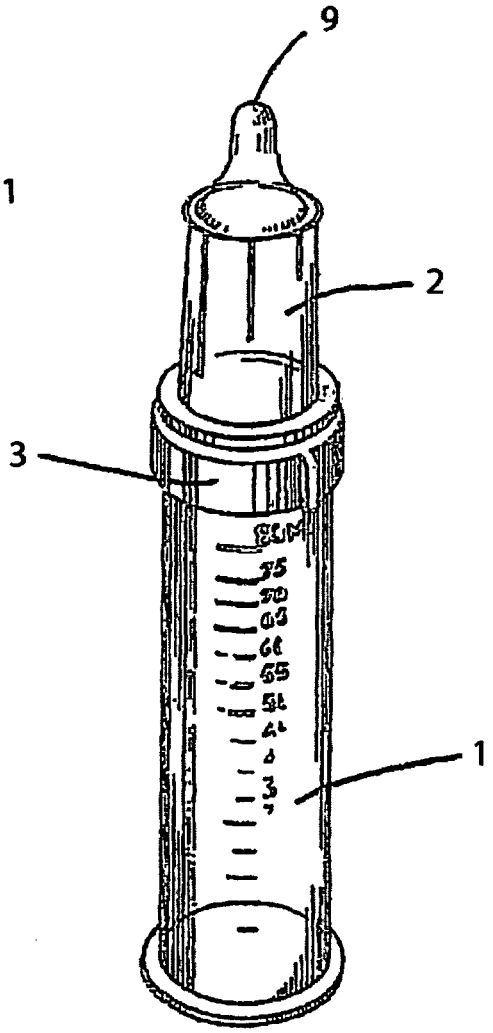
FIG. 1 is a perspective view of a prior art Mini-Haberman Feeder shown in an upright position.
Figure 2:
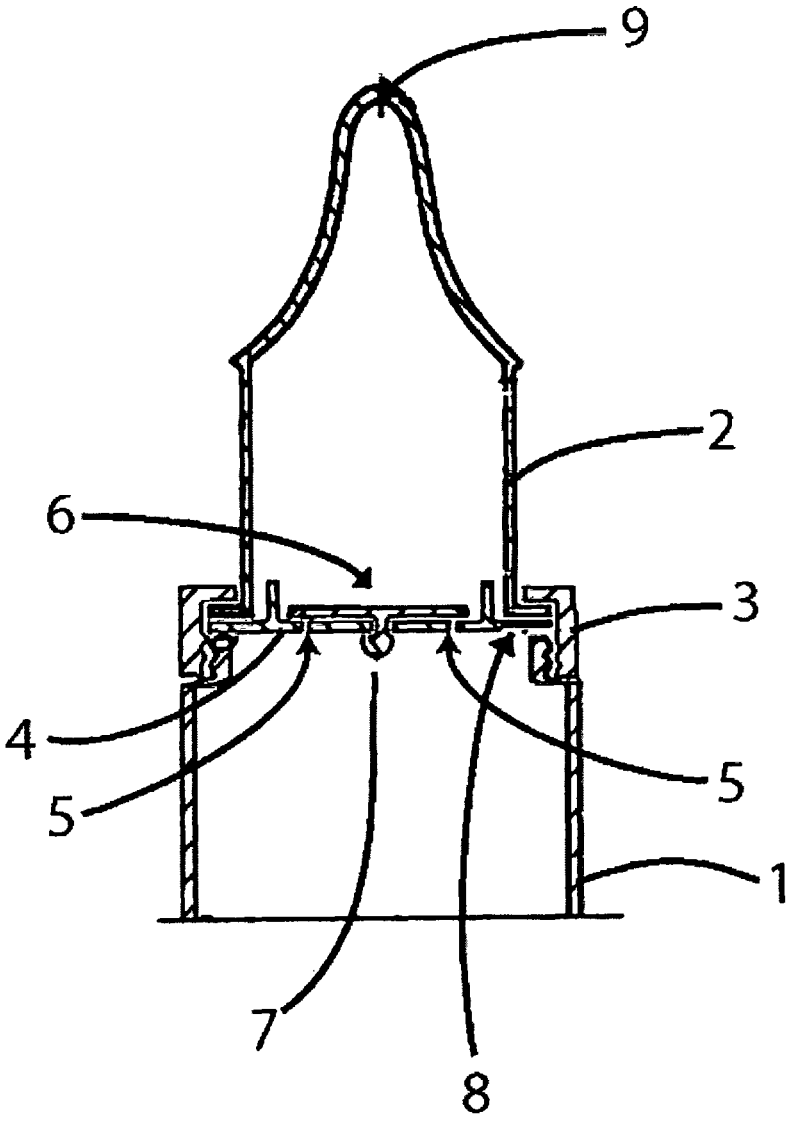
FIG. 2 is a longitudinal cross-section of the mouthpiece end of the apparatus of FIG. 1.
Figure 3:
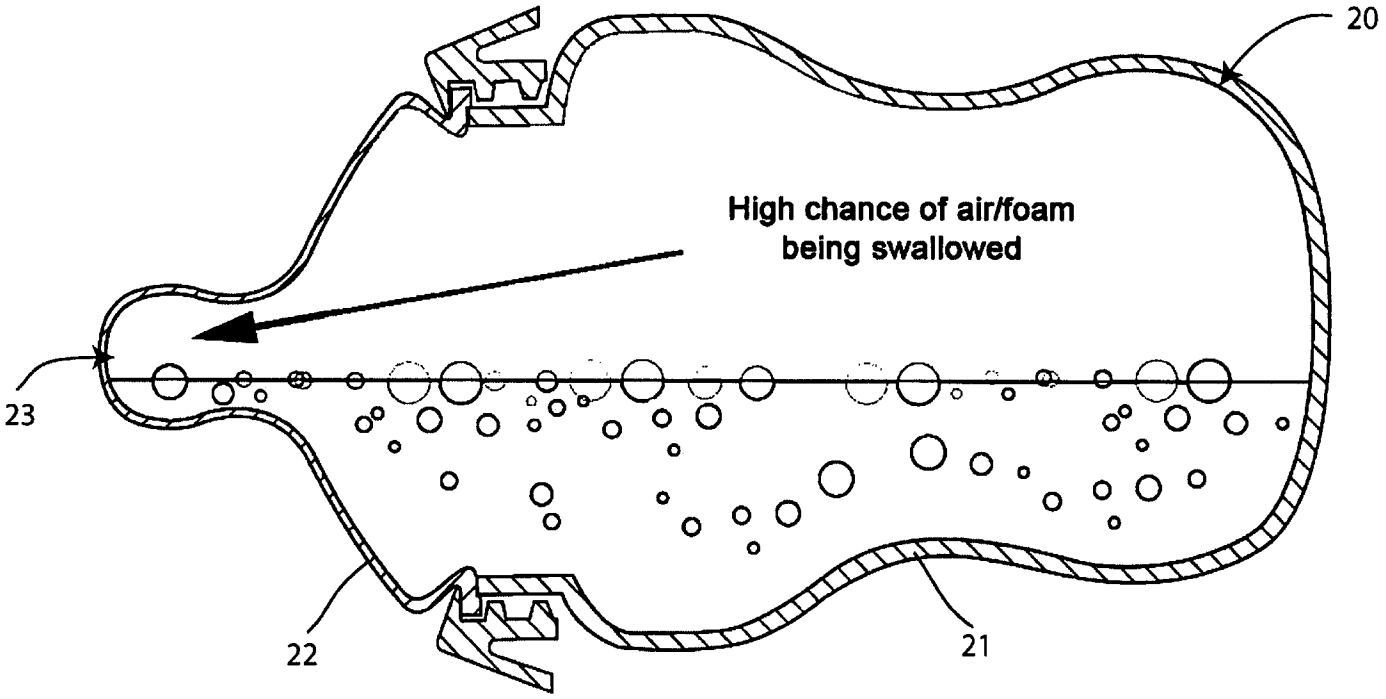
FIG. 3 is a longitudinal cross-section of a prior art convention baby feeding bottle, illustrating the high risk of air/foam being ingested by a feeding baby.
Figure 4:
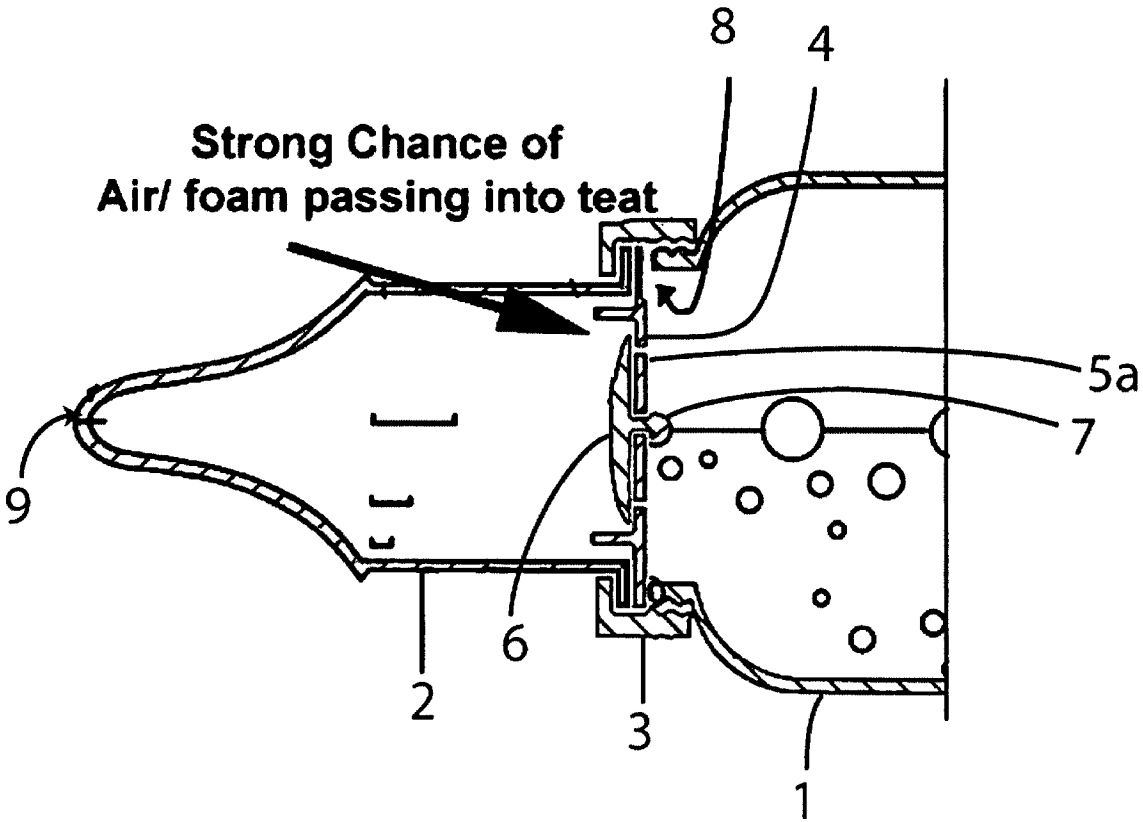
FIG. 4 is a view similar to that of FIG. 2, showing the strong risk of air/foam passing into the flexible mouthpiece of a Mini-Haberman Feeder and risking being ingested by a feeding baby.

In the Haberman Feeder (see FIGS. 2 and 4) the valve 4, 5, 6 between the main and secondary chambers is centred on the geometric centre of its partition or valve disc 4, so that at least one whole one of the four valve openings 5 is positioned above that geocentric centre. In contrast, in the feeding apparatus of the present invention the one-way valve 109 (or other flow restrictor) is provided in the partition 107 significantly offset from the geometric centre 111 of the partition 107. As will readily be appreciated from FIG. 5 (which shows an exemplary orientation for the apparatus 100), the significant offset of the one-way valve 109 from the geometric centre of the partition 107 enables the opening of the one-way valve 109 to be positioned entirely below the geometric centre 111 of the partition when the assembled apparatus 100 is held by a user with the teat 105 extending generally horizontally. Not only, as drawn, is the opening of the one-way valve 109 positioned entirely below the geometric centre 111 of the partition 107, but it is also spaced from the geometric centre 111 by a distance x. If the one-way valve 109 was to comprise a plurality of openings in the partition 107, all of the openings would be positioned below the geometric centre 111 of the partition 107.

The distance of the offset of the one-way valve 109 from the geometric centre 111 of the partition 107 influences the location within the main chamber 102 from which liquid feed will be drawn during use of the apparatus. If, as shown in FIG. 5, the partition 107 has a diameter d, ideally $x \geq 0.2$ d, preferably $\geq 0.25$ d and more preferably $\geq 0.3$ d.

It will be appreciated that, in use of the apparatus 100 (i.e. with the apparatus in the orientation shown in FIG. 5), liquid feed passing from the main chamber 102 into the secondary chamber 104 will be taken by the valve 109 from the bottom region of the volume of liquid feed contained within the main chamber 102. It is thought that this reduces the possibility for air/foam passing from the main chamber 102 through the one-way valve 109 into the secondary chamber 104. The reasons for this are several, and follow on from the discussion of the prior art above.

Firstly, because of the tendency of foam to rest on the top surface of liquid feed, taking the liquid feed from the bottom region of the volume of feed in the main chamber 102 reduces the possibility of foam passing into the secondary chamber 104 by delaying the arrival of the surface of the liquid feed at the valve 109 until near to the end of a feeding operation. Although the level of the liquid feed in the main chamber 102 may, towards the end of a feed, fall sufficiently that the top surface of the liquid feed becomes aligned with the one-way valve 109, foam on top of liquid feed (which is usually caused by shaking of the apparatus prior to commencement of the feeding operation) gradually clears during the feeding operation, so that delaying the arrival of the top surface of the feed at the valve 109 is beneficial.

Secondly, and as also mentioned in the prior art discussion above, small bubbles of air are also held in the liquid feed solution. The small size of the bubbles means that they are insufficiently buoyant as to rise quickly to the surface of the liquid feed and escape. However, over time, i.e. during the course of the feeding operation, these small bubbles will tend to bump into one another, coalesce and ultimately rise to the surface. Once again, by taking liquid feed from the bottom of the volume of feed contained in the main chamber 102, the portion of the volume of liquid feed contained in the main chamber 102 immediately upstream of the one-way valve 109 will be the first portion of the volume of liquid feed within the main chamber 102 to clear of these small bubbles, thereby once again contributing to reducing the amount of these small bubbles that is likely to pass through the one-way valve 109 from the main chamber 102 into the secondary chamber 104.

Thirdly, as discussed in the prior art discussion above, another reason for air being ingested by a child is one of the apparatus being held too close to the horizontal, thereby exposing the upstream side of the or a valve to air. In the embodiment of apparatus of the present invention illustrated in FIG. 5 it will be appreciated that the positioning of the one-way valve 109 in communication with the bottom region of the main chamber 102 reduces the likelihood of air passing through the one-way valve 109 into the secondary chamber 104 if the apparatus is held at the "wrong" angle.

Operation of the apparatus illustrated in FIG. 5 is generally similar to that of the mini-Haberman Feeder discussed above, in that the secondary chamber 104 is intended to be primed by holding the apparatus 100 with the mouthpiece 103 uppermost, squeezing the flexible walls of the mouthpiece 103, and then inverting the apparatus and releasing the squeezing action on the mouthpiece 103 to draw liquid feed from the main chamber 102 into the secondary chamber 104 through the one-way valve 109. The flexible walls of the mouthpiece 103 may be squeezed by the user squeezing together the flexible walls of the protruding teat 105. Alternatively, the user can use a thumb or forefinger to compress the generally flat section of the mouthpiece 103 adjacent the base of the protruding teat 105 back against the partition 107, by pressing in the direction of arrow 120 in FIG. 5. Repeating this action several times should substantially fill the secondary chamber 104 with liquid feed. By then holding the apparatus 100 in the orientation illustrated in FIG. 5, and using the apparatus to feed a baby, the suckling action of the baby will cause liquid feed to pass through the self-closing valve 106 of the teat 105 into the baby's mouth, with the liquid feed in the secondary chamber 104 being replenished by the flow of further liquid feed from the main chamber 102 through the one-way valve 109. To assist feeding, squeezing the teat 105 between a thumb and forefinger will force liquid out of the valve 106. However, as discussed below in relation to FIGS. 14 to 16, and FIG. 16 in particular, other means may be provided to assist in priming of the bottle.

The orientation illustrated in FIG. 5 is one in which the teat 105 extends generally horizontally, and in which the valve 109 is positioned directly below the geometric centre 111 of the partition 107. The longitudinal axis of the teat 105 is represented by the broken line 112 in FIG. 5. By "generally horizontally" is meant±10° for example. The apparatus is not, however, restricted to being used in the orientation illustrated in FIG. 5. For example, relative to the position illustrated in FIG. 5 the closed end of the container 101 could be substantially raised so that, in use, the longitudinal axis 112 of the teat 105 might be positioned at up to 45° from the horizontal. In some embodiments, the teat 105 may not be generally horizontal when the feeding apparatus is held in the operating position.

From the above discussion of an embodiment of feeding apparatus, as well as from the discussion of the prior art, it will be understood that air naturally separates from liquid feed (e.g. milk) over time, with the liquid feed at the bottom of a volume of feed containing a decreasing proportion of the total air in the feed over time. By positioning the flow restrictor, such as a one-way valve, within the partition so as to take liquid feed from the bottom region of the volume of feed contained within the main chamber 102, the amount of air available to pass from the main chamber 102 into the secondary chamber 104 is less than if the flow restrictor was located higher. Furthermore, because over time air within the liquid feed will escape from the liquid feed to and through the top surface of the volume of liquid feed, positioning the flow restrictor (for example one-way valve 109) so that the top surface of the volume of feed in the main chamber 102 is delayed in reaching the flow restrictor also minimises the amount of air that will be drawn through the flow restrictor.

The positioning of the air vent 110 generally opposite the flow restrictor (such as one-way valve 109), relative to the geometric centre 111 of the partition 107, also contributes to reducing the aeration of the liquid feed contained within the main chamber 102. As soon as the level of liquid feed contained within the main chamber 102 has dropped below the level of the air vent 110, air entering the main chamber through the vent 110 will enter into an air space within the main chamber 102, rather than into a volume of liquid feed, and will thus not contribute to aeration of the liquid feed.

A further contributor to reducing the amount of air ingested by a baby comes from the location of the protruding teat 105 and its self-closing valve 106. Rather than being positioned symmetrically with respect to the remainder of the mouthpiece 103 (as in the prior art devices illustrated in FIGS. 1-4), in the preferred embodiment of apparatus the protruding teat 105 is offset (by a distance y) relative to the geometric centre of the flange provided at the base of the flexible mouthpiece, which flange is clamped by the retaining collar or clamp 108. The geometric centre 111 of the partition 107 is coincident with the geometric centre of the flange provided at the base of the flexible mouthpiece 103. It can readily be seen from FIG. 5 how the protruding teat 105 is radially offset by distance y relative to that geometric centre 111 so as also to be positioned below the geometric centre 111 of the partition 107. Although in the embodiment of FIG. 5 the protruding teat 105 is not displaced as far radially from the geometric centre 111 (i.e. x>y) as is the one-way valve 109, in the other embodiments (not shown) it could be. Alternatively, the protruding teat 105 may not be radially offset at all. However, a benefit of the protruding teat 105 being offset so as to be in a "low" position (when the apparatus 100 is in the orientation illustrated in FIG. 5), is similar to the benefits obtained by the one-way valve 109 being situated "low" so as to draw liquid feed from the bottom of the volume of liquid feed contained in the main chamber 102. The "low" position of the protruding teat 105 means that the self-closing valve 106 provided at the end of the protruding teat 105 will be able to access liquid closer to the bottom of liquid feed contained within the secondary chamber 104, thereby contributing to reducing the amount of air that might pass through the self-closing valve 106 to the baby.

The advantages of the construction of the apparatus illustrated in FIG. 5 (namely a "low" position for the one-way valve 109 and a "low" position for the self-closing valve 106 of the teat 105 and a "high" position for the air vent 110) are reliant on the apparatus 100 being held in the correct orientation during feeding. If the apparatus was incorrectly to be held "upside down" (i.e. rotated 180° around the axis shown passing through the geometric centre 111 of the partition in FIG. 5), the advantages of the asymmetric location of the valves 106, 109 and vent 110 would become disadvantages. In order to indicate to a user of the apparatus the "correct" orientation for the apparatus for use in feeding, the apparatus may be provided with an indicator for indicating the "correct" orientation. This "correct" orientation is the one illustrated in FIG. 5, in which the one-way valve 109 is entirely positioned below the geometric centre 111 of the partition 107 whilst the assembled apparatus 100 is held by the user with the teat 105 extending generally horizontally (as shown). To position the opening of the valve 109 at the lowest point the valve is also vertically aligned with the geometric centre 111 of the partition 107.

The indicator takes the form of a visual element viewable by the user from externally of the apparatus. One or more visual elements may be provided. These visual elements might comprise a two-dimensional graphical element and/or a three-dimensional structural element. The intention of the visual element is so that, when the element is positioned at a pre-determined orientation relative to the geometric centre 111 of the partition 107 when the assembled apparatus 100 is held by the user with the teat 105 extending generally horizontally, the one-way valve 109 will automatically be positioned below that geometric centre. This visual element does not include the valve 109, which may in any event be impossible for the user to view when the apparatus is assembled and both chambers 102, 104 contain liquid feed.

In the illustrated embodiment of FIG. 5 at least three visual elements are present.

The first visual element is the asymmetric shape of the container 101. The container 101 is generally hour-glass shaped, with the reduced diameter central portion encouraging correct holding of the apparatus. The asymmetric shape of the container 101 is apparent from the fact that the central longitudinal axis 114 of the container 101 is not parallel or coincident with the central longitudinal axis 112 of the protruding teat 105. As a consequence, when the apparatus is held in a "correct" position with the central longitudinal axis 112 of the teat 105 extending generally horizontally, the longitudinal axis 114 of the container 101 makes an angle θ with the horizontal direction. This angle θ could be in the range 10-80°, but is more preferably in the range 10-50° and yet more preferably 10-40°. In the illustrated embodiment this angle θ is approximately 30°. If, therefore, the instruction manual accompanying the apparatus 100 informs the user of the apparatus that the container 101 should be held with the protruding teat 105 generally horizontal (i.e. axis 112 generally horizontal) and with the base of the container 101 above the level of the teat 105, holding by the user of the apparatus in this position (which is a particularly intuitive position if the container 101 is hour-glass shaped) will inevitably result in the apparatus being held in the "correct" orientation, i.e. with the one-way valve 109 in the partition 107 positioned entirely below the geometric centre 111 of the partition 107 so as to cause the liquid feed passing through the one-way valve 109 to be taken from the bottom of the volume of liquid feed contained within the container 101. As mentioned above, once the "correct" position as been adopted the base of the container 101 may be raised during or before actual feeding takes place.

The second visual element is the asymmetric construction of the flexible mouthpiece 103. For example, the instruction manual might tell the user that the longitudinal axis 112 of the teat 105 should, in use, be positioned generally horizontally and with the teat 105 lowermost (as shown in FIG. 5).

The third visual element is the provision of a graphical element on the apparatus 100, for example the printing of the word "TOP" on the portion of the wall of the container 101 that is intended to be held uppermost.

Other visual elements will be apparent to the skilled person. The above is not an exhaustive list. In some embodiments, an indicator may not be required.

Although the partition 107 is, in the illustrated embodiments, provided with a flow restrictor in the form of a single one-way valve 109, more than one such valve may be provided. Similarly, in embodiments which have an aperture instead of or in addition to a one-way valve 109, more than one aperture may be provided. Where a plurality of such valves or apertures are provided, all of such valves or apertures may be offset from the geometric centre of the partition so as to enable all of them to be, in use, positioned below the geometric centre of the partition.

FIGS. 14, 15 and 16 show an alternative embodiment of the present invention. In this embodiment, the partition member 107 described above in relation to the embodiment shown in FIG. 5 is replaced with a resiliently-biased cartridge in the form of a spring-loaded cartridge 500.

With reference to FIGS. 17 and 18, the cartridge 500, which may be removable from the main chamber 501 and mouthpiece 503, comprises a base section 580. The base section 580 contains a step 560 around its periphery, which step 560 is (in the assembled apparatus) seated on and receives a shoulder 570 formed around the interior of the open end of the main chamber 501. The base section 580 is not solid, so liquid feed from the main container 501 can freely pass backwards and forwards through one or more openings in the base section.

Extending forwardly from the base section 580, to a partition in the form of a solid plate 581 having a geometric centre 111, is a biasing means 582. This biasing means 582 takes the form of a plurality of resilient arms, which spiral inwardly from the ring of the base section and then extend forwardly as shown in FIGS. 14 and 16. The shape and resilience of these arms enable the spacing between the solid plate 581 and the base section 580 to be reduced by compressing these two elements together (thereby deforming the arms) against the returning bias of the biasing means 582, as will later be described. The individual nature of the resilient arms again does not impede the forward or reverse flow of liquid feed through the biasing means.

The solid plate 581 is a solid circular disc, with a flat forwardly facing surface around its periphery. Its solid nature does prevent the forward or reverse passage of liquid feed therethrough. Any liquid feed flowing between the main container 501 and the secondary chamber 104 is required to flow around the solid plate 580, for example through a flow restrictor which may be in the form of a one-way valve or an aperture.

Extending forwardly of the solid plate 581 is an operating element in the form of a funnel-shaped button element 583, whose extremity terminates in a rim 555, just behind the reverse surface of the part of the flexible mouthpiece 503 for reasons which will become apparent. The funnel-shaped button element 583 may be open or closed at the end provided with the rim 555. If open, the base is in any event closed by the solid plate 581, so liquid feed does not flow through the funnel shaped element.

It is envisaged that the base section 580, biasing means 582, solid plate 581 and button element 583 are integral, for example by being moulded in a resilient plastics material such as acetal to give the arms of the biasing means the necessary resilience to perform their biasing function.

As with the partition member 107, the resiliently-biased cartridge 500, or more particularly the plate 581 of the cartridge 500, acts to separate the main chamber 102 from the secondary chamber 104 in operation. The resiliently-biased cartridge 500 also assists in priming the bottle 100 before feeding, by facilitating transfer of the liquid feed from the main chamber 102 to the secondary chamber 104. The resiliently-biased cartridge 500 may also assist in draining or dumping liquid feed from the secondary chamber 104 to the main chamber 102 after use.

The resiliently-biased cartridge 500 is in a closed condition shown in FIGS. 14 and 16 during feeding, with the front surface of the solid plate 581 in sealing contact with a shoulder 526 extending around the majority of the circumference of the base of the mouthpiece 503. When in this position, the plate 581 of the cartridge 500 acts to form a partition, with liquid feed being able to pass from the main chamber 102 to the secondary chamber 104 around the edge of the plates 581 via a flow restrictor, in the form of a one-way valve comprising a flap 509 (this valve being similar to the one-way valve 109 described above in relation to the embodiment shown in FIG. 5).

In the embodiment shown in FIGS. 14, 15 and 16, the flexible mouthpiece 503 is provided with an indented area 550 and a teat having a central, longitudinal axis 112. The inner surface of this indented area 550 is in contact with, or in close proximity to, the rim 555. By placing a fingertip in the indented area and applying downward pressure the flexible mouthpiece can be deformed and pressure applied to the resiliently-biased cartridge 500. This pressure on the rim 555 overcomes the forward bias of the biasing means 582, causing the plate 581 to move rearwardly towards the stationary base section 580, i.e. switching the resiliently-biased cartridge 500 from the closed condition shown in FIG. 14 to the open condition shown in FIG. 15 by moving the plate 581 out of sealing contact with the shoulder 526.

As can be seen in FIG. 15, when the resiliently-biased cartridge 500 is in the open condition, the liquid feed is able to pass freely from the main chamber 102 to the secondary chamber 104, by passing through the gap created between the periphery of the plate 581 and the shoulder 526. This enables the bottle to be primed before use (by inverting the apparatus to fill the secondary chamber 104 with liquid feed rapidly), and/or for the secondary chamber 104 to be rapidly drained after use by pressing the indented area with the apparatus in the orientation shown in FIG. 15.

When pressure is removed from the indented area 550 the resiliently-biased cartridge 500 returns to the closed condition shown in FIG. 14. As described above, in this closed condition, the liquid feed must pass through the valve comprising the flap 509 (or other flow restrictor) in order to pass from the main chamber 102 to the secondary chamber 104.

In the embodiments shown in FIGS. 14, 15 and 16, the flow restrictor for permitting the forward flow of liquid feed from the main chamber 102 to the secondary chamber 104 and restricting the flow of liquid feed in the reverse direction is shown as comprising a flap 509. At least a part of this flap 509 forms a valve with the solid plate 581 of the resiliently-biased cartridge 500. In its relaxed state, the tip 1000 of the flap 509 may rest against the front face of the solid plate 581 of the resiliently-biased cartridge 500 as shown in FIG. 14. Alternatively, when the flap 509 is in its relaxed state, there may be a gap between the tip 1000 of the flap 509 and the solid plate 581 of the resiliently-biased cartridge 500 (FIG. 15). Thus, the flap 509 may be in a closed position or an open position in its relaxed state.

The flap 509 may, as shown in FIGS. 14, 15 and 16, be an integral part of the mouthpiece 503. The flap 509 may form a continuous circumferential flap. Alternatively, the flap 509 may only be formed over a portion of the circumference. In the embodiment shown in FIG. 14, there is a continuous circumferential flap formed integrally with the mouthpiece 503. At least a part of this flap 509 can open in the direction of the arrow 520 shown in FIG. 14 to allow liquid feed to pass from the main chamber to the secondary chamber. In this way, a portion 518 of the flap 509 can be deformed to the position shown in FIG. 16 during feeding. However, in the illustrated embodiment, only the portion 518 of the flap that is, in use, towards a lower portion (for example, lower half) of the feeding apparatus 100 is openable. Thus the portion 519 of the flap that is located towards the upper portion of the feeding apparatus 100 in use remains in contact with the solid plate 581 of the resiliently-biased cartridge 500, and thus does not allow the feed to pass by it. This can be achieved by forming the portion 518 of the flap 509 that opens and the portion 519 of the flap 509 that does not open from suitable materials, for example of different stiffness. Alternatively or additionally, the shape of the flap 509 could be arranged such that the portion 518 of the flap 509 which is openable requires a lower force to deform it into the open position than would be required to deform the portion 519 of the flap 509 which is not openable. For example, the flap portion 519 which does not open could be formed from a thicker material than the flap portion 518 that does open. The portion 518 that does open could be formed to be the lower half of the flap during operation. Alternatively, any other suitable angle in the lower half can be chosen. For example, the flap portion 518 that opens could be formed in the lowest 45° segment, the lowest 60° segment, the lowest 90° segment, the lowest 135° segment, or the lowest 180° segment.

As shown in FIGS. 14, 15 and 16, the fluid can pass around the solid plate 581 of the resiliently-biased cartridge 500 through an opening 511. This opening allows liquid feed in the main chamber 102 to come into contact with the upstream side of the flap 509. This opening may be a gap between the peripheral edge of the plate 581 and the inner wall of the mouthpiece 503 or container 501 and is advantageously located in the lower half of the feeding apparatus 100 when in use. In the illustrated embodiment this is achieved by providing a cut-away shoulder 525 in the inner surface of mouthpiece 503. As can be seen, the shoulder 525 is smaller than the shoulder 526. Thus, all of the advantages of drawing milk from the lower portion of the main chamber 102 described above are retained. There may be one opening 511, or more than one opening 511. Furthermore, in embodiments with more than one opening 511, the spacing between the openings 511 may be equal or not equal. Thus, the openings 511 could be provided as a series of pairs, i.e. two openings 511 provided close together with a larger angular separation between each pair of openings 511 than the angular separation between the two openings 511 forming the pair.

As explained above, at least a part of the flow restricting (valve) means may be provided as part of the mouthpiece 503. Furthermore, the position (for example the circumferential or angular position) of the or each flow restrictor may be entirely determined by the position of the mouthpiece 503 itself. In the example shown in FIGS. 14, 15 and 16, the internal surface of mouthpiece 503 is shaped such that gap 511 is formed between the cut-away shoulder 525 of the internal surface of the mouthpiece 503 and the plate 581 as described above. The extent of the circumferential location of shoulder 525 can at least partially (and in some cases fully) correspond to the circumferential location of the opening portion 518 of the flap 509. In the circumferential positions where it is desired not to allow liquid feed to pass beyond the plate 581 to contact the upstream portion of the flap 509, the surface of the inner wall of the mouthpiece 503 may be shaped so as to contact the plate 581 and thereby form a seal with it. For example, a "full" shoulder 526 may be provided on the inner surface of the mouthpiece 503. This arrangement ensures that the flow restrictor (such as a valve) is always at the correct position no matter how the feeder bottle 100 is assembled. This can be an important advantage, as the bottles are often assembled in non-ideal conditions, for example, in the dark or with time constraints. Other arrangements that ensure that the flow restrictor is always at the correct orientation when the feeder bottle 100 is assembled are also within the scope of the invention.

The feeder bottle 100/500 according to the present invention (for example, as shown in FIGS. 14, 15 and 16) is particularly easy to assemble. For example, the partition (formed by, for example, the resiliently-biased cartridge 500) can simply be dropped into position in the main container 501 such that a locating portion 560 formed by the step around the periphery of the base section 580 rests on the shoulder 570 of the main container 501. The flexible mouthpiece 503 can then be positioned on the resiliently-biased cartridge 500 (or partition), and the assembly can be clamped using a collar 508. In this way, only a small number of parts (e.g. only the resiliently-biased cartridge or partition member) that will subsequently come into contact with liquid feed need to be contacted when the feeder bottle 100 is assembled. In some embodiments, there is no need for any part of the flow restrictor or flow restrictors to be contacted during assembly or dismantling. This ensures that high levels of hygiene are maintained. Any parts that do need to be contacted during assembly can be contacted in a suitable manner (e.g. using tweezers).

The simple assembly of the apparatus of the feeder bottle 100 also means that the components can easily be separated, for example for cleaning.

The flow restrictors may have very few parts. For example they may comprise a gap between a part of the partition and a part of the flexible mouthpiece. In such embodiments, the cleaning of the flow restrictors can be straightforward. For example, there may be no fastners or fixers required to assemble the flow restrictors. No sub-assembly of parts may be required to form the flow restrictors in some embodiments, such as that shown in FIGS. 14, 15 and 16: they are automatically formed when the mouthpiece 503 and partition 581 (or resiliently-biased cartridge) are place together for assembly.

Optionally, the partition 581 may be formed by, or comprise, a cartridge 500, at least a portion of which is arranged to locate within the open end of the container 501 on assembly of the partition 581 to the container 501. This enables the formation of a sub-assembly of container 501 and cartridge 500 to which sub-assembly the mouthpiece 503 can be assembled, thereby forming the flow restrictor or flow restrictors.

As a result of the simple construction, when the mouthpiece 503 is assembled to and disassembled from the remainder of the apparatus the flow restrictor is automatically formed and unformed. As explained above, this means that all parts of the flow restrictors can be readily cleaned when the feeding apparatus is disassembled. In contrast, other feeding devices (such as the Haberman Feeder shown in FIG. 2) have no portion of the flow restrictor(s) (or valve(s)) formed by the flexible mouthpiece. Instead, the one-way valves are formed by a sub-assembly of parts that need to be pressed and retained together so as to form an assembled unit. This means that assembly and disassembly of the flow restrictor (valve) requires a separate disassembly operation in these alternative feeders. For example, in the Haberman feeder shown in FIG. 2, the valve disc 4 and the valve membrane 6 need to be separated from each other in order to fully disassemble the apparatus.

In such alternative feeders, disassembly of the flow restrictors is therefore not automatic, but requires an extra step to be performed. This extra step can be accidentally omitted from the disassembly. In that case, the flow restrictors would not be totally separated, and thus may not be cleaned properly. For example, if the valve membrane 6 of the Haberman feeder shown in FIG. 2 were not separated from the valve disc 4 before cleaning, then residue (for example from the liquid feed) may not be removed from the gap between the valve membrane 6 and the valve disc 4 during cleaning. This would be unhygienic, and could lead to bacteria growth, which could in turn be passed to the person feeding from the feeder. The construction of a feeder according to an embodiment of the present invention ensures that this hygiene problem does not occur, because the parts forming the flow restrictors are automatically separated upon disassembly of the feeder 100.

The invention claimed is:

1. A feeding apparatus comprising:

a container having an open end and for defining a main chamber therein;

a flexible mouthpiece for assembly to the open end of the container and for defining a secondary chamber therein, the mouthpiece including a protruding teat provided at a feeding end, the teat protruding along a longitudinal axis; and a partition having a geometric centre and for separating the main and secondary chambers upon assembly of the container to the flexible mouthpiece;

wherein said container, flexible mouthpiece and partition are constructed and arranged so that, when the flexible mouthpiece and partition are brought together during assembly of the apparatus for use, a flow restrictor, to allow liquid feed to flow from the main chamber to the secondary chamber, is automatically formed by a flow restrictor-forming portion of the flexible mouthpiece and a flow restrictor-forming portion of the partition, and is constructed and arranged to provide, during feeding, a greater resistance to the flow of liquid feed from the secondary chamber to the main chamber than to the flow of liquid feed from the main chamber to the secondary chamber;

wherein, when the assembled apparatus is held with the longitudinal axis of the teat extending horizontally, said flow restrictor can be positioned below the geometric centre of the partition and fluid drawn from the main chamber into the secondary chamber only from a lower half of the main chamber; and wherein the restrictor-forming portion of the flexible mouthpiece comprises a moveable flap of mouthpiece material.

2. An apparatus as claimed in claim 1, wherein the flexible mouthpiece and partition are constructed and arranged to form said flow restrictor regardless of the relative angular orientation of the flexible mouthpiece and partition in the assembled feeding apparatus.

3. An apparatus as claimed in claim 1, wherein the partition is part of a cartridge, at least a portion of which cartridge is arranged to locate within the open end of the container on assembly of the partition to the container to enable the formation of a sub-assembly of container and cartridge to which sub-assembly the flexible mouthpiece is arranged to be assembled on assembly of the apparatus.

4. An apparatus as claimed in claim 1, wherein the construction and arrangement of the container, mouthpiece, and partition is such that, when the mouthpiece and partition are separated during disassembly of the apparatus, said flow restrictor-forming portion of the mouthpiece and partition are automatically separated to facilitate their subsequent cleaning.

5. An apparatus as claimed in claim 1, wherein said flow restrictor is a one-way valve constructed and arranged to allow, during feeding, the flow of liquid feed from the main chamber to the secondary chamber and to prevent the flow of liquid feed from the secondary chamber to the main chamber.

6. An apparatus as claimed in claim 1, wherein the protruding teat is constructed and arranged so that, when the assembled apparatus is held by the user with the longitudinal axis of the teat extending horizontally and with said flow restrictor entirely positioned below the geometric centre of the partition, the protruding teat is also positioned below the geometric centre of the partition.

7. An apparatus as claimed in claim 1, wherein the moveable flap of mouthpiece material is configured to move away from the partition during feeding so as to reduce the resistance to the flow of liquid feed from the main chamber to the secondary chamber.

8. An apparatus as claimed in claim 7, wherein the flexible mouthpiece comprises a continuous circumferential flap and only a portion of this continuous circumferential flap forms said moveable flap of mouthpiece material configured to move away from the partition during feeding, the remainder of circumferential flap remaining in contact with the partition during feeding.

9. An apparatus as claimed in claim 1, wherein the partition is removable from both the container and the mouthpiece.

10. An apparatus as claimed in claim 1, wherein the protruding teat is constructed and arranged so that, when the assembled apparatus is held by the user with the teat extending generally horizontally and with said flow restrictor entirely positioned below the geometric centre of the partition, the protruding teat is also positioned below the geometric centre of the partition.

11. An apparatus as claimed in claim 1, wherein, when the apparatus is assembled, the interior of the main chamber adjacent the partition is free of any tubes and/or valves.

12. An apparatus as claimed in claim 1, wherein the movable flap of mouthpiece material is arranged to flex away from the flow restrictor-forming portion of the partition to enable the flow of liquid feed from the main chamber to the secondary chamber.

13. An apparatus as claimed in claim 1, wherein the partition is part of a resiliently biased cartridge, at least part of which cartridge is configured to be biased towards a first position by a biasing element, and is moveable against the bias from the first position to a second position, the biased cartridge being configured at least substantially to close a path for the flow of liquid feed between the main chamber and the secondary chamber when said moveable part is in the first position, and to open said path when said moveable part is in the second position.

14. A method of priming the secondary chamber of a feeding apparatus with liquid feed from the main chamber of the feeding apparatus, wherein the feeding apparatus is as claimed in claim 13, the method comprising:

assembling the feeding apparatus with liquid feed in the main chamber;

holding the feeding apparatus with the main chamber above the secondary chamber; and moving said moveable part of the partition from the first position to the second position to enable the flow of liquid feed into the secondary chamber from the main chamber.

15. A method of draining liquid feed from the secondary chamber of an assembled feeding apparatus to the main chamber of the assembled feeding apparatus, wherein the feeding apparatus is as claimed in claim 13, the method comprising:

holding the assembled feeding apparatus with the main chamber below the secondary chamber and with at least some liquid feed present in the secondary chamber; and moving said moveable part of the partition from the first position to the second position to enable the flow of said liquid feed into the main chamber from the secondary chamber.

16. An apparatus as claimed in claim 13, wherein, during feeding, the movable part of the cartridge is in the first position and the moveable flap of mouthpiece material moves out of contact with the movable part of the cartridge so as to reduce the resistance to the flow of liquid feed from the main chamber to the secondary chamber.

17. An apparatus as claimed in claim 16, wherein when the apparatus is not being used for feeding and the movable part of the cartridge is in the first position and the moveable flap of mouthpiece material is in contact with the movable part of the cartridge so as substantially to prevent to the flow of liquid feed from the main chamber to the secondary chamber, the movable part of the cartridge can be selectively moved against the bias from the first position to the second position so as to remove the moveable flap of mouthpiece material from contact with the movable part of the cartridge so as to enable liquid feed to pass freely between the main chamber and the secondary chamber in both directions.

18. An apparatus as claimed in claim 13, wherein the resiliently biased cartridge comprises:

a locating element configured to locate the resiliently biased cartridge relative to the container; and an operating portion configured to be contactable by at least a part of the flexible mouthpiece when the apparatus is assembled;

wherein said partition and said operating portion form the moveable part of the resiliently biased cartridge, said biasing element is configured to bias said moveable part towards said first position, and the operating portion is moveable against the bias of the biasing element by deformation of the part of the flexible mouthpiece with which it is contactable so as to move said moveable part against the bias of the biasing element from the first position to the second position.

19. An apparatus as claimed in claim 18, wherein the biasing element extends between the locating element and the moveable part of the resiliently biased cartridge.

20. An apparatus as claimed in claim 19, wherein the biasing element comprises a plurality of resiliently biased arms which deform to allow the moveable part of the resiliently biased cartridge to move relative to the locating element when the moveable part moves from the first position to the second position.

21. An apparatus as claimed in claim 18, wherein the biasing element is a spring.

* * * * *